US006681418B1

(12) United States Patent
Bierend et al.

(10) Patent No.: US 6,681,418 B1
(45) Date of Patent: Jan. 27, 2004

(54) WATER FLOW CONTROL DEVICE

(76) Inventors: Gary D. Bierend, 30405 Jasime Valley Dr., Canyon Country, CA (US) 91351; Paul H. Nicholas, P.O. Box 3701, Glendale, CA (US) 91221

( * ) Notice: Subject to any disclaimer, the term of this patent is extended or adjusted under 35 U.S.C. 154(b) by 0 days.

(21) Appl. No.: 10/113,523

(22) Filed: Apr. 1, 2002

Related U.S. Application Data

(60) Provisional application No. 60/281,009, filed on Apr. 4, 2001.

(51) Int. Cl.[7] ..... A47K 3/12

(52) U.S. Cl. ..... 4/661; 4/675; 137/494; 137/496; 251/30.02

(58) Field of Search ..... 4/661, 675; 137/494, 137/496, 505, 100; 251/30.02, 43, 45

(56) References Cited

U.S. PATENT DOCUMENTS 4,176,680 A * 12/1979 de Launay ..... 137/496

4,917,137 A * 4/1990 Symmons ..... 137/98

* cited by examiner

*Primary Examiner*—Gregory Huson
*Assistant Examiner*—Azy Kokabi
(74) *Attorney, Agent, or Firm*—Albert O. Cota

(57) ABSTRACT

A water flow control valve (10) designed to be installed externally on a toilet tank (108) or as an integral element of a toilet ballcock (110). The valve (10) incorporates a diaphragm (46), a spring (62), a poppet assembly (70), and an inlet port (38) that is connected to a utility water supply (100) and an outlet port (42) that is connected through a pipe (102) to a fitting (106) on the the toilet tank (108). The valve functions by sensing the pressure at the inlet port (38). When no large demands are placed on the water supply (100), the valve (10) remains open, thus allowing the toilet tank (108) to fill. When a shower is turned on, the water pressure drops which reduces the upward force on the diaphragm (46), thus allowing the spring (62) to place the poppet (70) in a closed position which prevents the toilet tank (108) from filling. When the water demand ceases, the water pressure opens the valve (10), which allows the toilet tank (108) to fill.

14 Claims, 5 Drawing Sheets

WATER FLOW CONTROL DEVICE

The application claims priority of Provisional Patent Application number 60/281,009 filed Apr. 4, 2001.

TECHNICAL FIELD

The invention pertains to the general field of pressure sensing and control devices and more particularly to a valve which allows a first water source to automatically maintain a set flow rate and temperature when a second interconnected water source is operated.

BACKGROUND ART

One potential hazard in an average home is a person using a shower when, at the same time, some sudden major demand is made upon the water system. For normal use a shower has a hot and cold setting, which are chosen depending upon the user's preferred water temperature and flow. It is common for cold water appliances such as sink faucets, washing machines, dishwashers or flushed toilets to rob the available water flow. This leaves a heavy flow of hot water to the shower as the line pressures adjust to the change. The result can be a scalded bather which is a potentially serious medical injury. The present invention is an automatic device which senses normal water pressure and is operated by a sudden drop in that pressure by the water lines. The primary culprit to control in such happenings is the flushing of a toilet in one or more of the house bathrooms. The safety feature of this invention is best utilized when it is placed in series with the input water line of any household toilet or other fixtures.

A search of the prior art, which included U.S. patents and industry catalogs, did not disclose any devices that read on the claims of the instant invention.

DISCLOSURE OF THE INVENTION

The water flow control valve is designed to be installed externally onto an appliance, such as a toilet tank, or to be included as an integral element of a toilet ballcock assembly. In either design, the valve operates in combination with a common utility water supply. The water supply is connected to a first fixture that is being supplied hot and cold water at a preset flow rate and to a second fixture that is operated with cold water. The valve is designed to allow the first fixture to continue supplying the water at the preset flow rate when the second cold water fixture is operated.

The first fixture is typically comprised of a shower and the second fixture is typically comprised of a toilet assembly. When the toilet assembly is flushed, the water present in the tank will allow the toilet assembly to be flushed. However, following the flush, if the shower is in use., the valve is designed to operate, thereby restricting the flow of water into the toilet tank until the water flow from the shower is turned off. The curtailment of the cold water flow into the toilet tank prevents cold water from being taken from the water mixture of the shower. Thus, the water flowing from the shower remains at the preset temperature.

The water flow control valve is comprised of a valve body consisting of an upper section and a lower section. The upper section houses a spring whose tension is adjusted by a spring tension adjustment knob. The lower section includes an inlet port that is connected to a utility water supply and an outlet port that is connected to a fitting on the toilet tank. The lower section also houses a poppet assembly that, in combination with the spring and a diaphragm that is clamped between the upper and lower sections, controls the opening and closing of the valve. When the poppet assembly is in a downward position, the water flow from the inlet port to the outlet port is restricted. Conversely, when the poppet assembly is raised by the water pressure, the tension provided by the spring, water will flow from the inlet port into and out of the outlet port.

In view of the above disclosure, the primary object of the invention is to produce a water flow control valve that prevents a shower delivering water at a comfortable preset temperature to suddenly deliver water at a higher temperature. The higher temperature, which can cause scalding, can occur when a toilet is flushed and a portion of the cold water mix from the shower is diverted to fill the toilet tank.

In addition to the primary object of the invention, it is also an object to produce a water flow control valve that:

- can be constructed of metal, plastic or a composite material,
- is reliable and is easily maintained,
- can be designed to be installed externally or to be incorporated into a toilet tank ballcock or other fixture, and
- is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment for a water flow control valve 10 (hereinafter "valve 10"), which allows a first fixture, such as a shower, to remain supplying water at a preset constant temperature when a second fixture such as a toilet assembly 98, is flushed. The second fixture, in addition to the toilet assembly 98, can also consist of a a washing machine, a dishwasher or the like. However, for brevity, the disclosure that follows will be limited to the use of the valve 10 on the toilet assembly 98.

Figure 2:
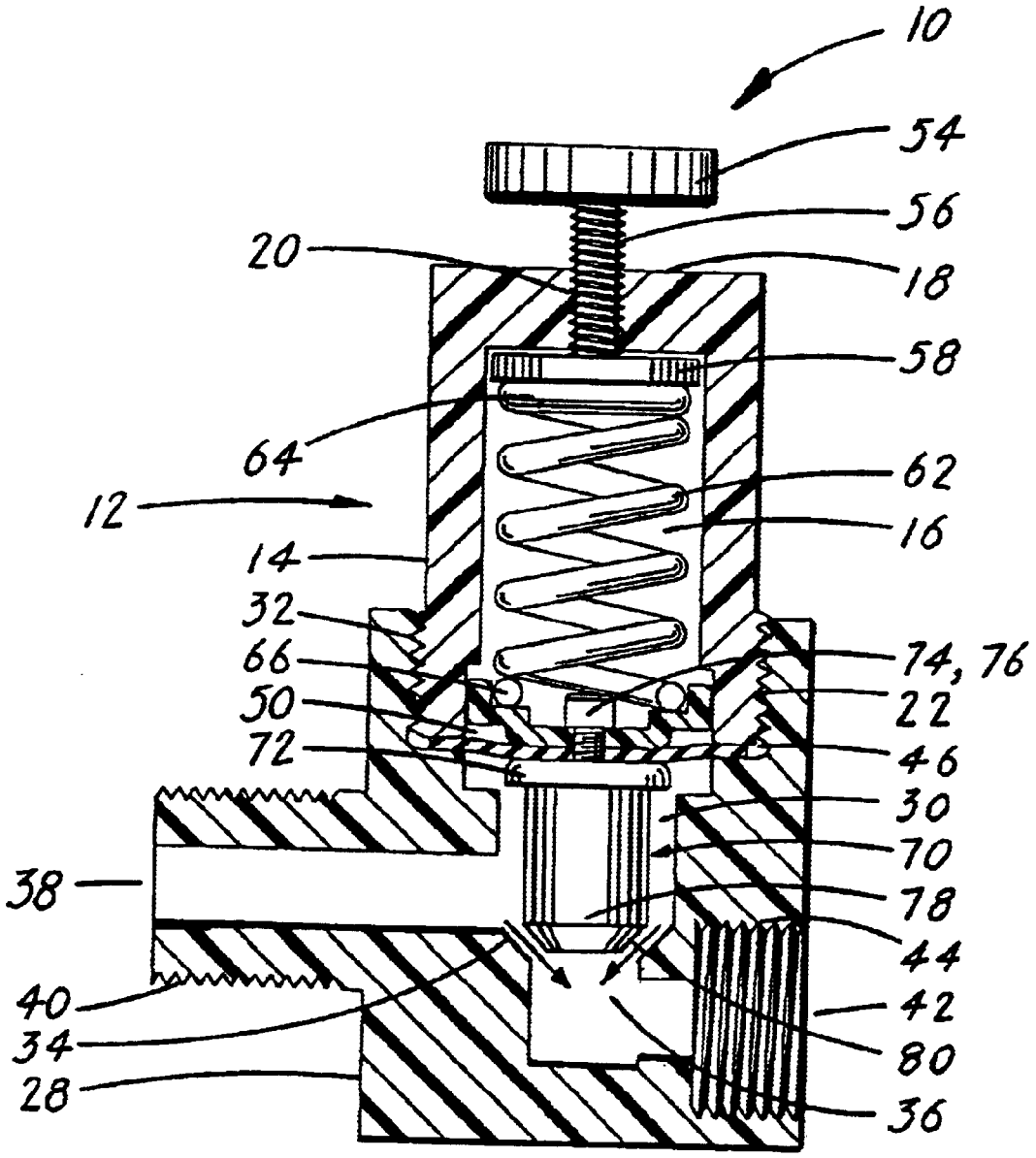
FIG. 2 is a sectional side view of the valve with the poppet assembly shown in an open position, which allows water to flow through the valve.
Figure 3:
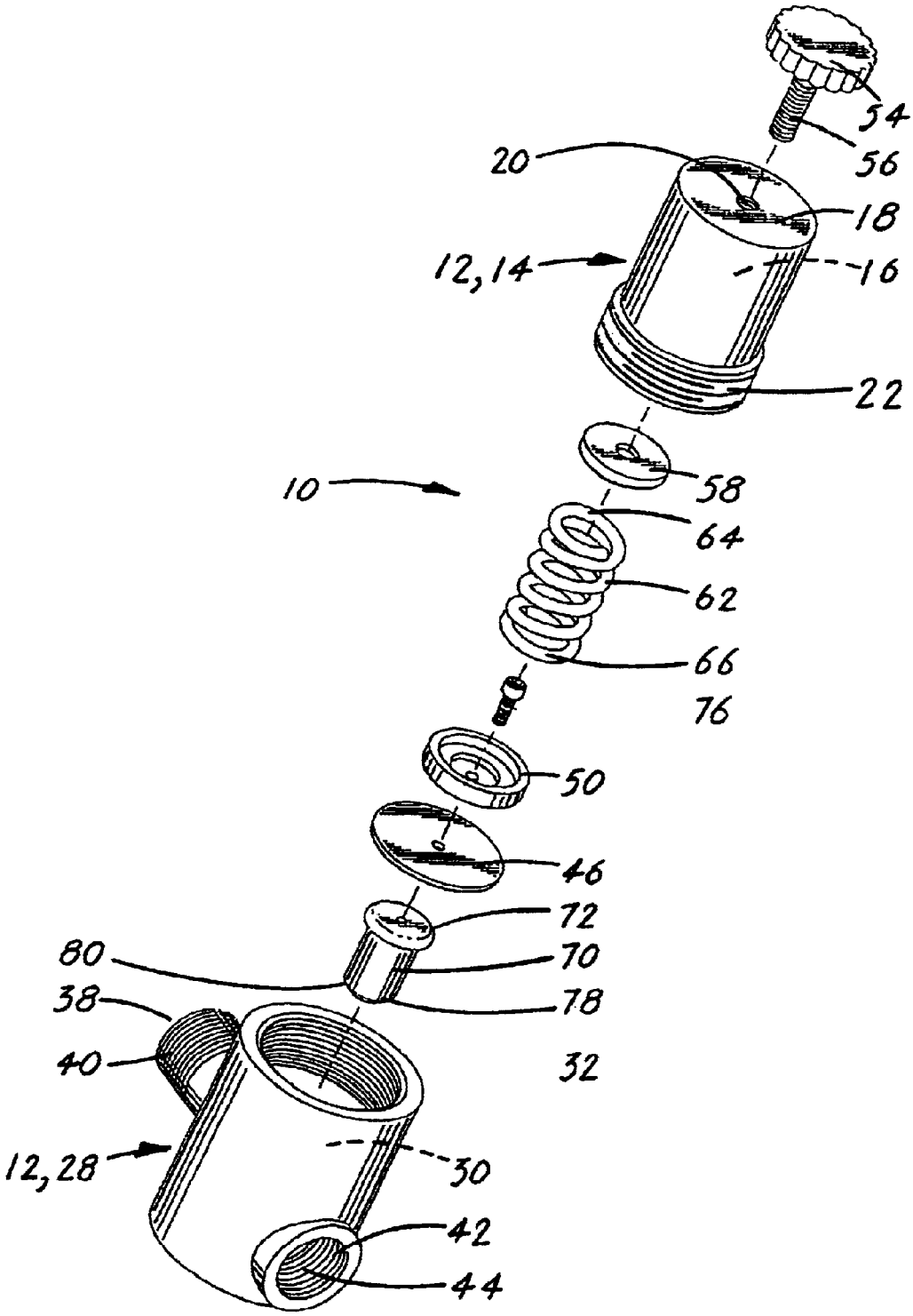
FIG. 3 is an exploded perspective view of the valve.
Figure 4:
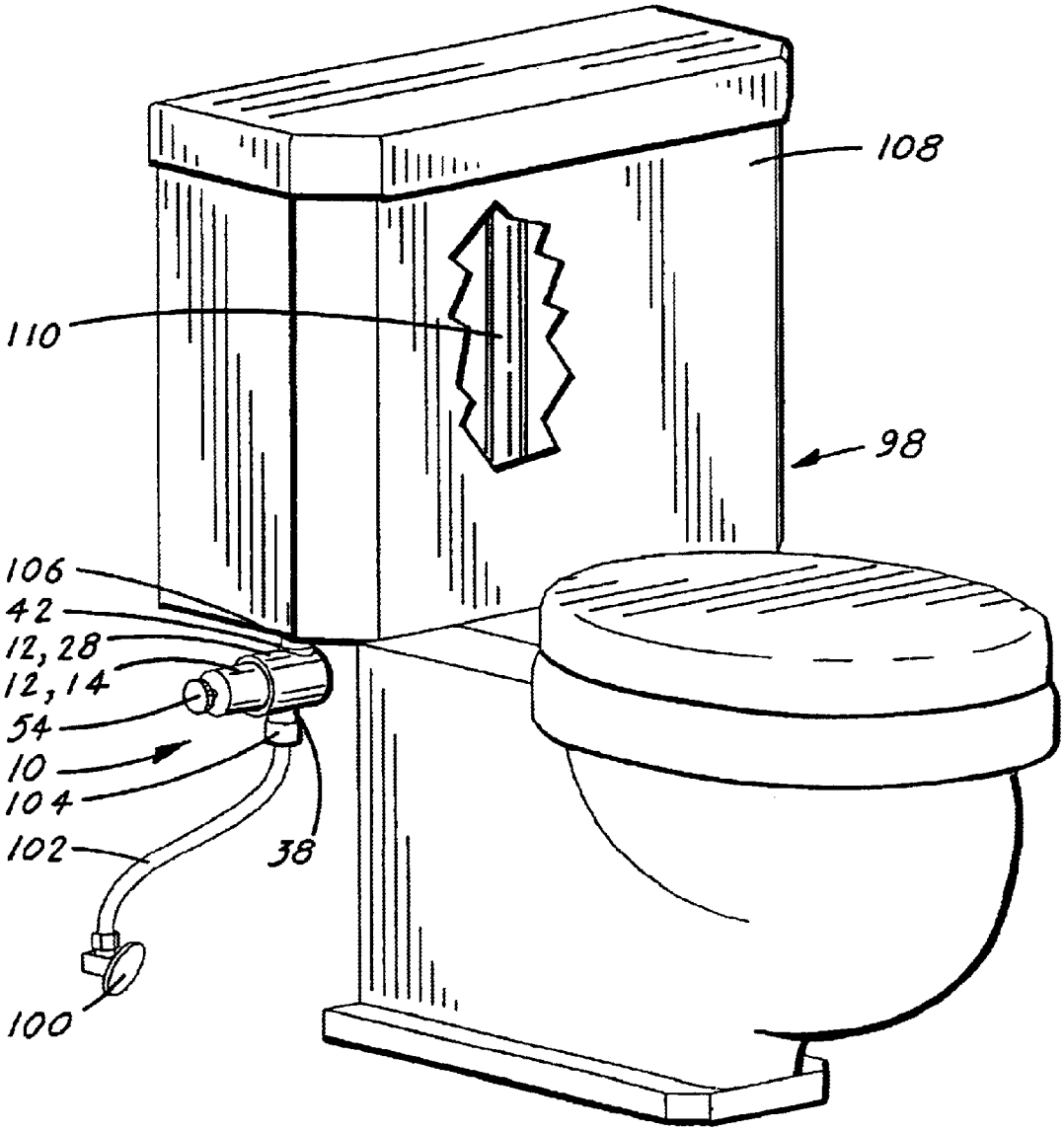
FIG. 4 is a perspective view of the valve shown located between a toilet water tank and a domestic water supply.

The preferred embodiment of the valve 10, as shown in FIGS. 1–5, is comprised of the following major elements: a valve body 12, a diaphragm 46, a spring tension adjustment knob 54, a spring 62, and a poppet assembly 70. The valve 10 is designed to be used and operated in combination with a utility water supply 100 that is connected through a pipe 102 to a standard male fitting 106 projecting from the toilet tank 108, as shown in FIG. 4.

Figure 1:
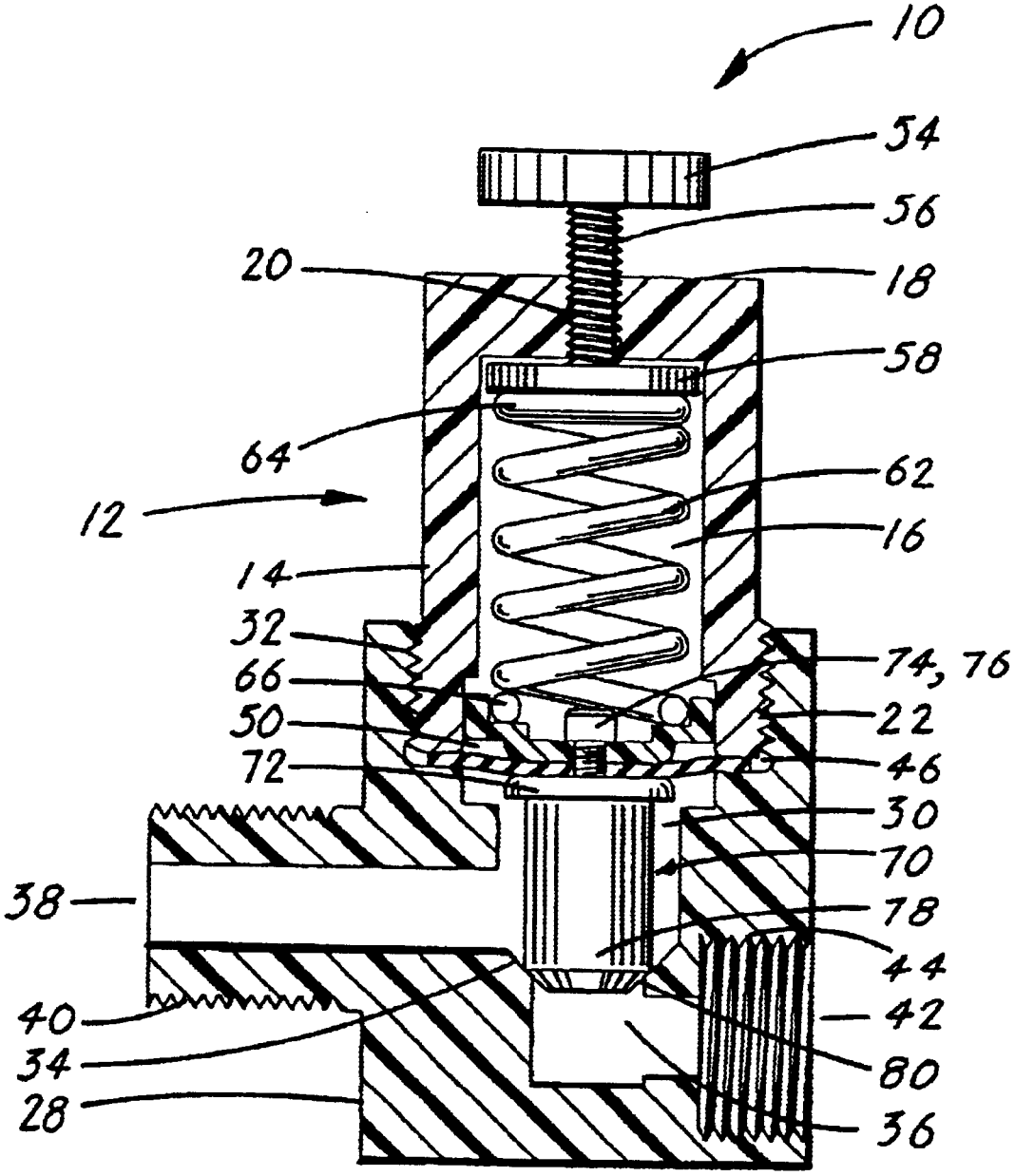
FIG. 1 is a sectional side view of the water flow control valve with a poppet assembly shown in a closed position, which prevents water from flowing through the valve.

The valve body 12, as shown in FIGS. 1, 2 and 3, is comprised of an upper section 14 and a lower section 28.

Both sections can be made of a metal or of a high-impact plastic. The upper section has an up-ward extending spring cavity 16 that terminates with an upper cap 18, a substantially-centered, threaded knob bore 20 and a set of lower external threads 22. The threaded knob bore 20 is designed to accept a threaded shaft 56 that extends from the spring tension adjustment knob 54. The lower section includes a downward-extending poppet cavity 30 having a set of internal threads 32 that are dimensioned to mate with the set of external threads 22 located on the upper section 14. Alternatively, the two units 4,18 can be attached by an adhesive (not shown).

The poppet cavity 30 terminates with an angled seating bore 34 that intercepts an internal passage 36, which connects an inlet port 38 and an outlet port 42.

The inlet port 38 includes a set of external threads 40 that are dimensioned to accept a standard toilet tank female fitting 104 that through a pipe 102 is connected to the utility water supply 100, as shown in FIG. 4. Likewise, the outlet port 42 includes a set of external threads 44 that are dimensioned to accept a toilet tank standard male fitting 106 that projects from the base of the toilet tank 108, as also shown in FIG. 4.

The diaphragm 46, as shown in FIGS. 1, 2 and 3, is made of a resilient material such as neoprene that is clamped between the upper section 14 and the lower section 28. The diaphragm 46 is designed to create a tight seal between the two sections 14,28.

As best shown in FIG. 3, over the diaphragm 46 is located a spring retaining insert 50 that interfaces with the end of the shaft 56 on the adjustment knob 54.

The poppet assembly 70, as also shown in FIGS. 1, 2 and 3, is comprised of an upper section 72 and a lower section 78. The upper section 72 interfaces with the diaphragm 46 and is attached thereto by an attachment means 74 that typically consists of a screw 76. The poppet assembly 70 is attached to the diaphragm 46 so that it can move up and down within the body while maintaining the pressure tight seal provided by the diaphragm. The lower section 78 terminates with an angled face 80 that is dimensioned to fit into the angled seating bore 34 on the lower section 28. When the poppet assembly is sealed, the water flow from the inlet port 38 to the outlet port is restricted. In this configuration, the valve is "closed" as shown in FIG. 1.

When the poppet assembly 70 is located at its highest position, the internal passage 36 is opened, thus permitting water flow from the inlet port 38 into and out of the outlet port 42. In this configuration, the valve is "open" as shown in FIG. 2.

The spring 62, has an upper end 64 that interfaces with the spring retaining disc 58 and a lower end 66 that interfaces with the spring retaining insert 50. The spring is designed to push downward on the poppet assembly 70. When no pressure is applied into the inlet port 38, the spring 62 moves the poppet assembly 70 downward, restricting the flow through the valve 10. When the pressure applied in to the inlet port 38 becomes high enough to overcome the force of the spring 62, the poppet assembly 70 moves upward, opening the valve 10. The spring tension adjusting knob 54 that is threaded into the upper section 14 allows the preload on the spring 62 to be adjusted. This provides control over the opening pressure of the valve 10.

When no water is being used in a typical utility water supply 100, the water pressure is at its maximum value. When a shower or other large demand is turned on, the pressure drop in the water piping and the pressure "droop" in the water supply regulator causes the water pressure throughout the house to drop by several pounds per square inch.

The valve 10 functions by sensing the pressure at the inlet port 38 and then either opening or restricting the valve 10 based on the inlet pressure. When the valve 10 is properly adjusted, the valve is open when no large demands are placed on the utility water supply 100. This is because the force of the water pressure against the diaphragm 46 is high enough to overcome the force of the spring 62 and raise the poppet assembly 70 to its "open" position, as shown in FIG. 2. While the valve 10 is open, the toilet tank 108 is allowed to fill normally.

When the shower (or another large demand) is turned on, the supply pressure falls by several pounds per square inch. This reduces the force acting upward on the diaphragm 46, and the spring 62 is then able to drive the poppet assembly 70 downward to a restricted or closed configuration, as shown in FIG. 1, which prevents the toilet tank 108 from filling. When the demand is turned off, the water pressure rises and the valve 10 opens again, allowing the toilet tank to fill.

Notice that any large demand on the utility water supply 100 will have the same effect on the filling of the toilet tank 108 as running the shower. This may be slightly inconvenient at times but is a reasonable tradeoff for preventing incidents of shower scalding.

Figure 5:
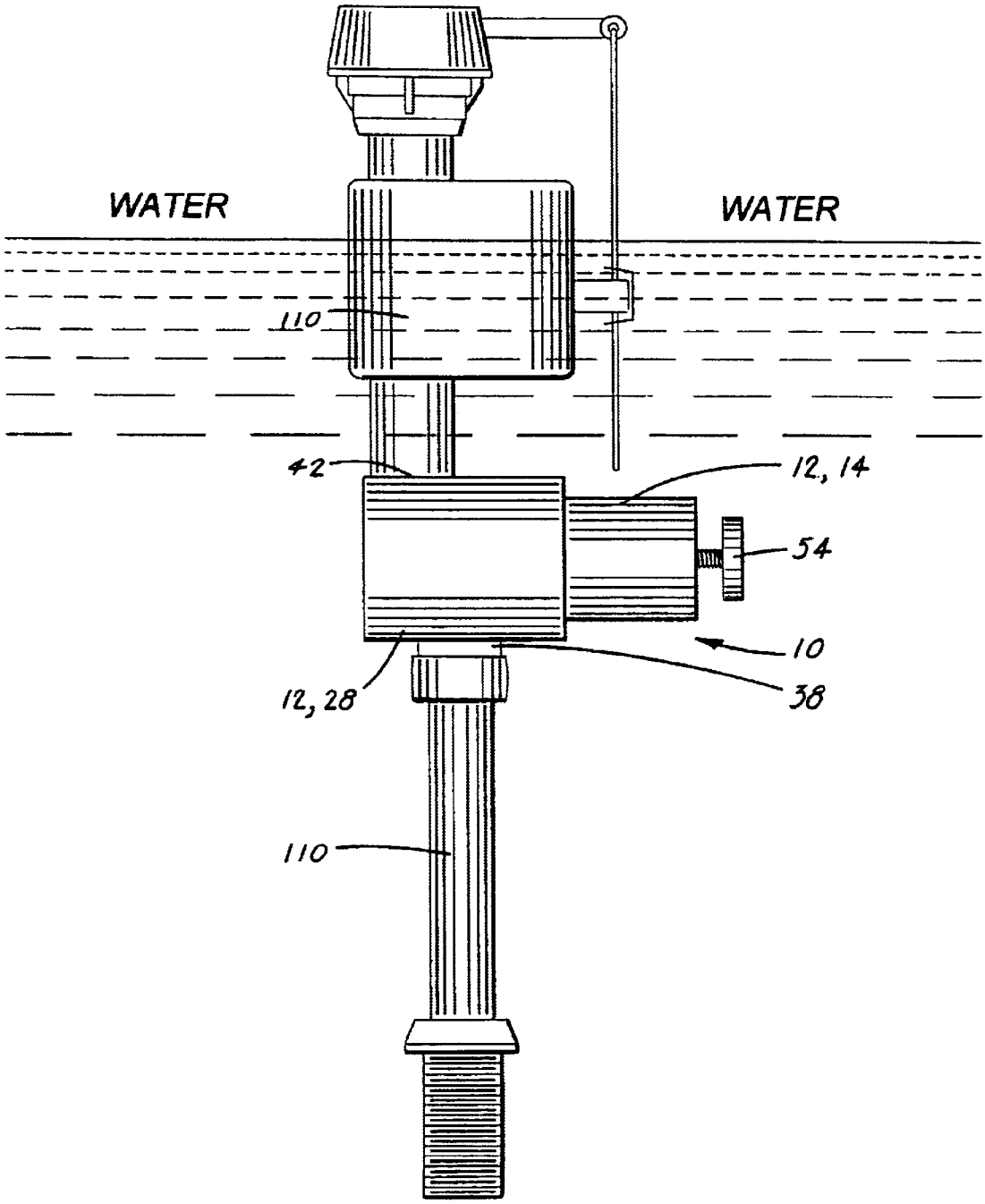
FIG. 5 is an elevational side view showing the valve assembly as an integral element of a toilet ballcock.

The water flow control valve 10 is primarily designed to be easily installed externally to a toilet tank 108, as shown in FIG. 4. However, as shown in FIG. 5, the water flow control valve 10 can also be designed to be included as an integral element of a toilet ballcock 110 or used with another fixture, such as a washing machine or a dishwasher.

To install the valve 10, as shown in FIG. 4, the inlet port 38 of the valve 10 is connected through a standard female fitting 104 via a pipe 102 to the utility water supply 100. The outlet port 42 is then connected to a standard male fitting 106 projecting from the base of the toilet tank 108. No other connections are necessary.

After the valve 10 is installed, as shown in FIG. 4, the water flow control valve 10 is adjusted to function properly. The adjustment procedure is accomplished during a time when there are no fixtures, sprinkler systems, or appliances using water in the house. To adjust the valve 10, run the shower at its normal flow and flush the toilet 98 while the shower is running. If the toilet 98 starts to fill, turn the spring tension adjusting knob 54 clockwise until the water flow is reduced. Then turn the shower off. If the toilet 98 starts to fill normally, the valve 10 is properly adjusted. If the toilet 98 does not start to fill, turn the adjusting knob 54 counter-clockwise until the toilet 98 begins to fill. Check for proper adjustment by again turning on the shower and flushing the toilet 98. The valve 10 is properly adjusted when the shower does not change temperature when the toilet 98 is flushed.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

What is claimed is:

1. A water flow control valve that operates in combination with a common utility water supply connected to a first fixture supplying water at a preset flow and temperature, and a second fixture that is operated with cold water, said valve having means for allowing the first device to continue supplying the water at the preset flow and temperature when the second fixture is operated, wherein the first fixture is comprised of a shower and the second fixture is comprised of a toilet assembly having attached a toilet tank, wherein when the toilet assembly is flushed, the water present in the toilet tank allows the toilet assembly to flush and following the flush said valve operates, restricting a flow of water into the toilet tank until the water flow from the shower is turned off, wherein the curtailment of the toilet's cold water flow prevents cold water from being taken from the water mixture of the shower, thus, the water flowing from the shower remains at the preset temperature.

2. The water flow control valve as specified in claim 1 wherein said valve comprises:

a) a valve body comprising:

(1) a upper section having an upward-extending spring cavity that terminates with an upper cap having therethrough a substantially-centered knob bore and a set of lower external threads, (2) a lower section having a downward-extending poppet cavity having a set of internal threads that are dimensioned to mate with the set of external threads on said upper section, wherein the poppet cavity terminates with an angled seating bore that intercepts an internal passage that connects an inlet port with an outlet port, (b) a resilient diaphragm clamped between the upper section and the lower section, wherein said diaphragm creates a tight pressure seal between the two sections, c) a spring retaining insert fitted over said diaphragm, d) a spring tension adjustment knob having a threaded shaft that is threadably inserted through the knob bore and that interfaces with a spring retaining disc, e) a spring having an upper end that interfaces with the spring retaining disc and a lower end that interfaces with the spring retaining insert, and f) a poppet assembly having:

(1) an upper section that interfaces with the diaphragm and is attached thereto by an attachment means, and (2) a lower section that terminates with an angled face that is dimensioned to fit into the angled seating bore.

3. The valve as specified in claim 2 wherein the inlet port is located normal to the surface of said lower section and include a set of external threads.

4. The valve as specified in claim 2 wherein the outlet port is located opposite the inlet port and normal to the surface of said lower section and includes a set of internal threads.

5. The valve as specified in claim 1 wherein the inlet port on said valve is connected to a standard fitting located on a valve controlling the utility water supply, and the outlet port is connected to a standard fitting located on the toilet tank water inlet port.

6. The valve as specified in claim 2 wherein to install said valve the inlet port on said valve is connected through a standard female fitting via a pipe to a utility water supply, and the outlet port is connected to a standard male fitting projecting from the base of the toilet tank.

7. The valve as specified in claim 1 wherein said means for attaching said poppet assembly to said diaphragm comprises a screw.

8. The valve as specified in claim 2 wherein said resilient diaphragm is made of neoprene.

9. The valve as specified in claim 2 wherein the upper and lower sections of said valve body are made of metal.

10. The valve as specified in claim 2 wherein the upper and lower sections of said valve body are made of high-impact plastic.

11. The valve as specified in claim 2 wherein when no pressure is being applied into the inlet port, said spring moves said poppet assembly downward, closing the valves, and preventing water from flowing into the toilet tank, conversely when the pressure applied to the inlet port is sufficient to overcome the force of the spring said poppet assembly moves upward, opening said valve and allowing water to flow into the toilet tank.

12. The valve as specified in claim 1 wherein the preload applied to the spring is adjusted by means of the spring tension adjustment knob.

13. The valve as specified in claim 1 wherein said valve is designed to be included as an integral element of a toilet ballcock assembly.

14. The valve as specified in claim 1 wherein said valve is designed to be attached to fixtures such as washing machines and dishwashers.

* * * * *